US005647277A

United States Patent [19]

DeVito

[11] Patent Number: 5,647,277

[45] Date of Patent: Jul. 15, 1997

[54] SKIP-SCORER, SKIP-PERFORATOR APPARATUS FOR USE WITH PRINTING PRESS SYSTEMS

[76] Inventor: Anthony J. DeVito, 19251 Brookhurst, Space 91, Huntington Beach, Calif. 92646

[21] Appl. No.: 585,910

[22] Filed: Jan. 16, 1996

[51] Int. Cl.[6] ..... B41F 13/26

[52] U.S. Cl. ..... 101/226; 400/621; 400/621.2; 493/370; 493/396; 83/886; 83/332; 83/347

[58] Field of Search ..... 101/224, 226, 101/227; 400/620, 621.1, 621.2; 493/340, 355, 347, 353, 354, 365, 370, 363; 83/882, 886, 887, 883, 884, 337, 346, 347

[56] References Cited

U.S. PATENT DOCUMENTS

| | | | |
|---|---|---|---|
| 1,196,912 | 9/1916 | Weck | 493/396 |
| 2,729,028 | 1/1956 | Slayter et al. | 83/347 |
| 2,735,488 | 2/1956 | Anderson et al. | 101/224 |
| 3,855,892 | 12/1974 | DiLello et al. | 83/347 |
| 4,512,256 | 4/1985 | Schriger et al. | 101/226 |
| 4,524,962 | 6/1985 | Davenport et al. | 493/397 |
| 4,982,639 | 1/1991 | Kirkpatrick | 83/347 |
| 5,045,045 | 9/1991 | Davenport et al. | 83/332 |
| 5,133,235 | 7/1992 | DeVito | 83/347 |

FOREIGN PATENT DOCUMENTS

| | | | |
|---|---|---|---|
| 2138408 | 3/1972 | Germany | 83/332 |

*Primary Examiner*—Eugene H. Eickholt
*Attorney, Agent, or Firm*—G. Donald Weber, Jr.

[57] ABSTRACT

Attachments for use with existing cylinders or shafts in printing press equipment. The attachments are used to mount a scoring blade, a perforating blade or an anvil to the cylinder or shaft. The blade or the anvil is separably mounted to the attachment and to the cylinder for easy assembly and disassembly.

20 Claims, 2 Drawing Sheets

SKIP-SCORER, SKIP-PERFORATOR APPARATUS FOR USE WITH PRINTING PRESS SYSTEMS

BACKGROUND

1. Field of the Invention

The present invention relates, generally, to the field of printing press systems and, more particularly, to improved paper perforating and scoring devices for use with continuous web printing presses.

2. Prior Art

Expensive, high speed printing presses are commonly used by commercial printing companies. Many such printing presses are fed from large rolls of paper, in a continuous strip known in the art as a "web". The presses are generally known in the industry as web presses and may cost millions of dollars each.

Typically, a web press requires the use of an automated web cutting and folding machine to receive the printed web at high velocity. The cutting and folding machine automatically cuts the web into sheets and folds the sheets into "signatures". The signatures may be sold as produced or they may be delivered to other machines which bind the signatures into books, magazines, or the like.

It can be appreciated that the presses and folding machines must be capable of operating for extended periods of time at very high speeds in order to be cost effective in the production of finished signatures.

Many commonly used signature folders are constructed to perform two or more sequential paper folding operations. The first folding stage is typical inasmuch as the web is still intact and taut when the first fold is made. However, any subsequent fold (which can be repeated several times) is, generally, accomplished by a blade striking the severed sheet along a second fold line and pushing the new fold between a second (and subsequent) pair of rollers.

To avoid the use of two separate signature folders, each of which is operated at half the press speed, press and folder manufacturers have attempted to reduce the second stage folding problems by scoring the web along the second fold line before the first fold is made. For such pre-fold scoring, the web passes through a web scoring apparatus in the signature folder upstream of the first folding stage. The scoring apparatus, typically, includes a circular scoring blade mounted on one side of the web and a resilient roller mounted on the other side of the web. As the web advances between the rotating scoring blade and roller, the blade presses a longitudinal indentation or groove into the web along the subsequent second fold line.

The web is scored in alternating directions. Such a device is referred to as a "skip-scorer" and is described in U.S. Pat. No. 4,524,962.

The skip-scorer of the prior art includes first and second rollers each having separate scoring and resilient abutment portions to score the paper web in alternating directions. The scoring means are mounted in the path of paper travel so as to enable scoring of the paper before the paper enters the first folding stage.

The known scoring means comprise first and second complementary-shaped scoring rollers, each of which has alternating peripheral scoring blades and resilient roller portions having arc lengths equal to the length of the fold. The first and second scoring rollers are, typically, rotatably mounted upstream of the first folding stage and in the path of paper web travel. The scoring rollers are mounted in mutual, peripheral rolling contact so that the respective scoring blade contacts the respective resilient roller portion (or anvil) of the other as the scoring rollers are rotated. Portions of the paper passing between the scoring rollers are thereby scored in one direction and other portions of the paper are scored in the opposite direction so that each layer of paper is scored in the correct folding direction.

However, this operation tends to cause the resilient portion of the rollers to wear down. When the resilient portions wear down, the scoring does not occur accurately. Thus, it is necessary to replace the resilient portion of the roller. This replacement is time consuming and expensive in that the roller must be removed from the press and a new roller inserted. The technique is, generally, not satisfactory A more economical arrangement for scoring and/or perforating is described in U.S. Pat. No. 5,045,045 of H. Davenport et al. In this apparatus, the scorer and/or perforator includes a blade bolted to a semi-circular hub or support which is bolted to the roller. The anvil is a resilient, T-shaped strip which is embedded in a T-shaped slot in a semi-circular hub or support. The anvil support and the blade support are bolted to each other and clamped to the drive shaft. In this apparatus, replacement of a worn anvil strip is simplified. That is, the anvil support is removed from the shaft. The worn T-shaped resilient strip is removed and replaced by a new strip. The hub or support is then bolted into place. This entire process is quicker, easier and less expensive than that in the prior art. Nevertheless, improved desived are still desirable.

PRIOR ART STATEMENT

The most pertinent prior known to Applicant is listed herewith in numerical order with no significance intended to the ordering.

U.S. Pat. No. 1,196,912; ADJUSTABLE CREASING OR SCORING MECHANISM; E. E. Weck. This patent is directed to a self-contained mechanism capable of scoring a paper along parallel lines spaced apart by any distance.

U.S. Pat. No. 1,525,238; SLOTTING AND SCORING DEVICE; N. L. Hurd. This patent is directed to an apparatus for slotting and scoring box-board materials with a pair of slotting blades spaced apart by a prescribed distance.

U.S. Pat. No. 1,839,491; SCORING MECHANISM FOR ENVELOPE MACHINES AND THE LIKE; A. Novick. This patent is directed to a mechanism for scoring envelope blanks preparatory to folding the blanks into a finished envelope.

U.S. Pat. No. 3,198,092; SCORE MOISTENING DEVICE; H. F. Koran. This patent is directed to an attachment for sheet folding systems which moistens the surface of one or more scoring rollers so that the sheets may be moistened in the areas of the scores thereby producing more effective and more accurate folding of the sheets.

U.S. Pat. No. 3,917,254; APPARATUS FOR FOLDING OF A WEB; H. N. Watrous. This patent is directed to an apparatus which includes a pair of cooperating rollers which roll along fold lines of web in order to loosen the bonds in the web transverse to the ultimate fold lines thereby facilitating folding.

U.S. Pat. No. 3,949,654; ASSEMBLY FOR USE IN A MACHINE FOR PROCESSING SHEET OR SIMILAR MATERIAL; H. Stehlin. This patent is directed to an assembly for processing of sheet material wherein a rotatable tool and an opposing part are positionally adjustable to various spacing therebetween and include toothed shafts which operate as feed rollers for feeding sheet material to the apparatus.

U.S. Pat. No. 4,014,535; CONTINUOUS SHEET COLLATING METHOD AND APPARATUS; R. E. Kleid et al. This patent is directed to a continuous sheet collating system.

U.S. Pat. No. 4,046,366; METHOD FOR PRODUCING BOOKS; W. B. McCain, et al. This patent is directed to a method for producing books by juxtaposing webs of printed material obtained from rolls which are cut, folded twice and delivered to a saddle conveyor for trimming.

U.S. Pat. No. 4,416,652; UNIT FOR SCORING WEBS OF PAPER IN THE LENGTHWAYS DIRECTION; R. Fischer, et al. This patent is directed to an apparatus which includes a folder blade for producing a lengthways fold relative in a web of paper.

U.S. Pat. No. 4,524,962; PRE-FOLD, WEB SCORING APPARATUS FOR SIGNATURE FOLDING MACHINE; H. D. Davenport et al. This patent is directed to a printing system which includes a scoring means for applying a pre-fold score in alternating directions along a longitudinal line in the paper to be scored.

U.S. Pat. No. 5,045,045; SKIP-SCORER, SKIP-PERFORATING FOR USE WITH PRINTING PRESS SYSTEMS; H. D. Davenport et al. This patent is directed to an improved skip-scorer, skip-perforator apparatus.

U.S. Pat. No. 5,133,235; SKIP-SCORER, SKIP-PERFORATING FOR USE WITH PRINTING PRESS SYSTEMS; A. J. DeVito. This patent is directed to an attachment which is mounted in an annular groove formed within an existing cylinder in printing press equipment. Arcuate roller attachments are mounted to an existing cylinder in a conventional web handling machine. The existing cylinder is modified by forming an axial groove in the periphery thereof for receiving transverse blade and/or anvil roller attachments.

SUMMARY OF THE INSTANT INVENTION

According to the present invention, an improved scoring and/or perforating apparatus is provided for a machine through which a web, e.g. paper, is fed. The scoring/perforating apparatus includes a first roller attachment having either a scoring blade or a perforating blade and a second roller attachment having a resilient abutment portion for engaging the peripherial edge of the blade.

The two roller attachments are mounted on a drive shaft in mutual, peripheral rolling contact with another similar arrangement of roller attachments so that the scoring/perforating blade portion of one roller attachment contacts the resilient portion of the other roller attachment as the rollers are rotated. Depending upon the blade utilized, the paper passing between the roller attachments is thereby scored or perforated.

The blade is a rigid, relatively narrow device with an outer, peripheral edge designed to score or perforate the paper in the apparatus. The anvil is a generally T-shaped strip or pad of resilient material, such as urethane. The blade is bolted to the blade holder. The anvil is inserted into and interlockingly engaged in the anvil holder which includes a plurality of removable clamps which are bolted together to form the holder. The pad and the blade are easily mounted or removed from the respective holder for simple replacement.

DESCRIPTION OF A PREFERRED EMBODIMENT

While a printing press is not a part of this invention, per se, and is not described herewith, some background discussion is deemed appropriate.

Pertinent to the instant invention, a pair of attachments are mounted to rollers or cylinders of a printing press to operate on the web (typically, a paper sheet) which passes between the attachments. In the prior art, one attachment includes a perforator blade or a scorer blade which is bolted to a blade holder. The blade holder is mounted on a roller shaft or in a suitable slot or groove which is formed radially in the outer surface of the typical printing press cylinder.

A companion attachment includes a T-shaped anvil which is placed in a T-shaped slot in an anvil holder. Typically, the anvil is fabricated of a relatively rigid but resilient material such as hard rubber or the like. The anvil holder is also mounted on the roller shaft or in the slot or groove in the outer surface of the printing press cylinder.

The anvil mounted in one cylinder (or on one roller shaft) is arranged to cooperate with the blade mounted in a companion cylinder (or roller shaft) as the cylinders (or shafts) rotate. That is, the companion cylinders or shafts are journaled at an appropriate spacing in the press so as to permit the web to pass therebetween while permitting the blade to engage and score or perforate the web in conjunction with the anvil. This apparatus is conventional in the printing press art and is used in several types of equipment. However, the instant invention is directed to improvements to the attachments referred to above.

Figure 1:
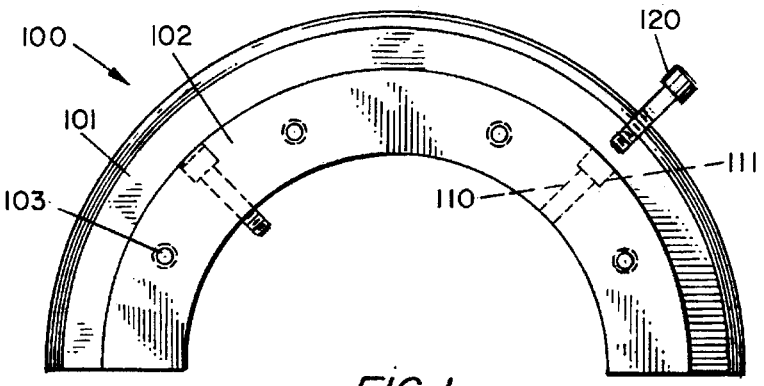
FIG. 1 is a partially broken away view of one embodiment of the perforator blade attachment of the instant invention.

Referring now to FIG. 1, there is shown a partially broken away elevation view of one embodiment of a scorer blade attachment 100 for use with a printing press apparatus as described supra.

The scorer blade attachment 100 includes a scorer blade 101 which is bolted to a blade holder 102. Typically, the blade holder 102 is mounted in a groove formed in the outer surface of a press cylinder or on a press shaft. Consequently, the blade 101 and blade holder 102 are shown in semi-circular form which is the typical configuration. The scorer blade 101 has a smooth, slightly rounded outer edge 171 which extends outwardly from the outer circumference of the blade holder 102.

A plurality of mounting holes 103 pass through the body of blade 101. A similar plurality of apertures 104 extend into blade holder 102. A suitable bolt 150 passes through the aperture 103 in blade 101 and is threadedly engaged in aperture 104 in blade holder 102 in order to securely mount the blade 101 to the holder 102.

A plurality of elongated holes 110 (shown in dashed outline) are drilled axially through the blade holder 102. The apertures 10 are countersunk or counterbored to form a recess or cavity 111 at the outer end thereof. Appropriate bolts 120 are inserted into and passed through the apertures 110 into threaded apertures in the surface of the underlying support cylinder (not shown). Thus, the blade 101 is mounted to the blade holder 102 which is mounted to the cylinder by means of the bolts 120.

Figure 2:
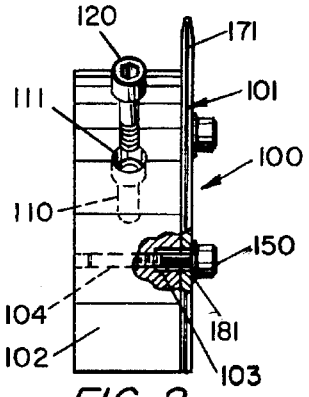
FIG. 2 is a cross-sectional view of the perforator blade attachment shown in FIG. 1.

Referring now to FIG. 2 there is shown a cross-sectional view of the attachment 100 of the instant invention including blade holder 102 and blade 101. As shown in FIG. 2, the blade 101, which is typically formed of hardened steel, is attached to blade holder 102 by bolt 150 which passes through blade 101 and threadedly engages blade holder 102. Typically, bolt 150 is a shoulder bolt to provide satifactory mounting capability. In addition, a high collar washer 181 is included in order to position the bolt 150 relative to the blade attachment 100 and vice versa. The blade 101 is arranged to project slightly beyond the surface of blade holder 102. Thus, the blade edge 171 can interact with the web which passes thereby.

As shown in FIG. 1, the aperture 110 passes axially through blade holder 102. The aperture 110 is shown countersunk to receive an Allen bolt 120 or the like. The bolt 120 then engages the underlying cylinder or a companion blade holder when mounted on a press shaft.

Figure 3:
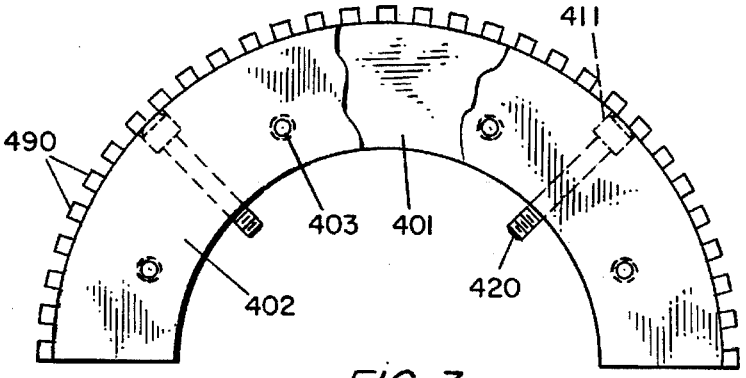
FIG. 3 is a partially broken away view of one embodiment of the scorer blade attachment of the instant invention.

Referring now to FIG. 3, there is shown a partially broken away, elevation view of one embodiment of a perforator blade attachment 400 which includes a perforator blade 401 mounted to blade holder 402. The blade 401 and holder 402 are shown in semicircular form which is the typical configuration. A plurality of perforator teeth 490 extend outwardly from the outer circumference of the blade 401.

A plurality of mounting holes 403 pass through the body of blade 401. A similar plurality of apertures 404 extend through blade holder 402. A suitable bolt 450 (similar to bolt 150) passes through the aperture 403 in blade 401 and threadedly engages aperture 402 in holder 402 in order to securely mount the blade 401 to the holder 402. The bolt 450 also passes through a high collar washer 481 which assists in securing the blade 401 to the holder 402.

Figure 4:
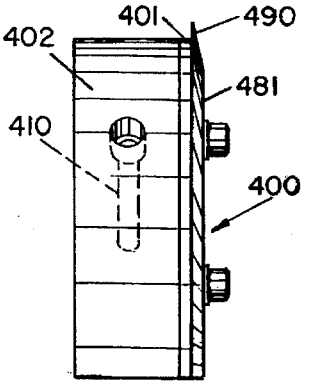
FIG. 4 is a cross-sectional view of the scorer blade attachment shown in FIG. 3.

Referring now to FIG. 4 there is shown a cross-sectional view of attachment 400 including the blade holder 402 and blade 401 of the instant invention. As shown in FIG. 4, the holder assembly 400 includes a support structure i.e. blade holder 402 which (like blade holder 102) has a generally rectilinear cross-sectional configuration. The blade holder 402 (as well as blade 401) are generally semi-circular in configuration (see FIG. 5) and are arranged to closely conform to the outer surface of the support cylinder in the existing printing press. The blade 401, formed of hardened steel, for example, is arranged to have the teeth 490 project slightly beyond the surface of blade holder 402. Thus, the teeth 490 of blade 401 can interact with the web which passes thereby.

Typically, perforator blade 401 has a total thickness equal to the thickness of scorer blade 101. However, the outer rim of blade 401 is reduced in thickness, for example, by about one-half. For example, a scorer blade can be machined to include a thinner outer edge into which teeth 490 are cut. As a consequence, the teeth 490 are slightly off-center relative to the plane of blade 401. More particularly, the inner edge of the teeth 490 is at or near the center line of blade 401; however, the entire body of each of the teeth is offset relative to the body of the blade 401. (Of course, the blade 401 can be manufactured to provide "centered" teeth, if so desired.)

In this embodiment, blade 401 is attached to blade holder 402 by the bolts 450 which threadedly engage the blade holder. (This portion of the perforator blade attachment 400 is substantially similar to the scorer blade attachment 100 described supra.) This arrangement permits easy replacement or adjustment of the blade 401. Of course, by tightening bolt 450, the blade 401 is secured to the blade holder 402.

A plurality of elongated holes 410 are drilled axially through the blade holder 402. The apertures 410 are countersunk or counterbored to form a recess or cavity 411 at the outer end thereof. Appropriate bolts 420 are inserted into and passed through the apertures 410 into threaded apertures in the surface of the underlying support cylinder (not shown). Thus, the blade holder 402 is mounted to the cylinder (or a companion blade holder) by means of the bolts 420.

By making the holes 410 somewhat elongated in shape, an appropriate adjustment of the blade holder 402 as well as the blade 401 can be effected. That is, the blade holder 402 can be adjusted axially along the support cylinder by sliding the elongated apertures 410 relative to the associated bolts 420.

Figure 5:
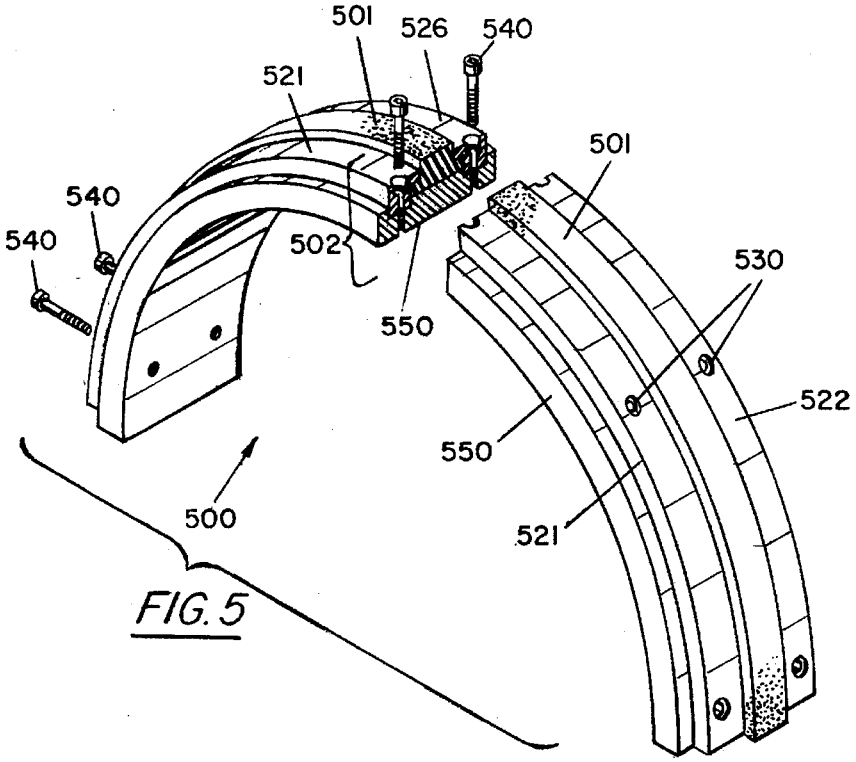
FIG. 5 is a partially exploded, perspective view of one embodiment of an anvil attachment of the instant invention.

Referring now to FIG. 5, there is shown a partially exploded perspective view of one embodiment of an anvil attachment 500 of the instant invention. As described supra, the anvil attachment 500 includes the anvil 501 and the anvil holder 502.

In this embodiment, the anvil 501 is an inverted T-shaped strip of sturdy, resilient material such as polyurethane or the like. The upper surface 510 of anvil 501 is, typically, adapted to engage the edge of the scorer blade 101, for example.

The anvil holder 502 includes the holder base 550 and the holder straps 521 and 522. The components of anvil holder 502 are formed of hardened steel or the like and are formed in a semi-circular configuration similar to the blade holders described supra.

The holder straps include a plurality of axial holes 530 therethrough. The holes 530 are countersunk in order to receive the end of bolts 540 which are similar to bolts 120 and/or 420 described supra.

The holder base 550 includes a similar plurality of holes 510 therethrough. These holes match with the holes 530 so that the bolts 540 pass through the straps and the base and threadedly engage the underlying structure such as a shaft, a cylinder, or a companion blade holder.

As is seen, the holder straps 521 and 522 are mounted on opposite sides of the anvil 501. When the straps are bolted to the cylinder (through the base 550), the anvil 501 is clamped securely to the anvil holder and, thus, to the underlying shaft or cylinder.

The anvil attachment 500 has the advantages that replacement of the anvil 501, per se, is easily accomplished (relative to the prior art). In addition, the anvil attachment 500 inhibits slippage of the anvil 501 relative to the underlying cylinder or shaft.

As shown in the embodiment of FIG. 5, the holder base 550 includes grooves 523 and 524 in the upper surface thereof. The grooves 523 and 524 are relatively shallow and are adapted to receive the bottom portion of the holder straps 521 and 522, respectively. The straps and grooves, preferrably, form a reasonably snug fit.

The holder straps 521 and 522 also include the lips 525 and 526, respectively, which engage the horizontal cross-bar of the inverted T-shaped anvil 501. Clearly, the relative sizes, thicknesses and spacing of the anvil 501, the holder straps 521 and 522 and the lips 525 and 526 are selected so that a suitable pressure is exerted by the holder straps on the anvil.

Figure 6:
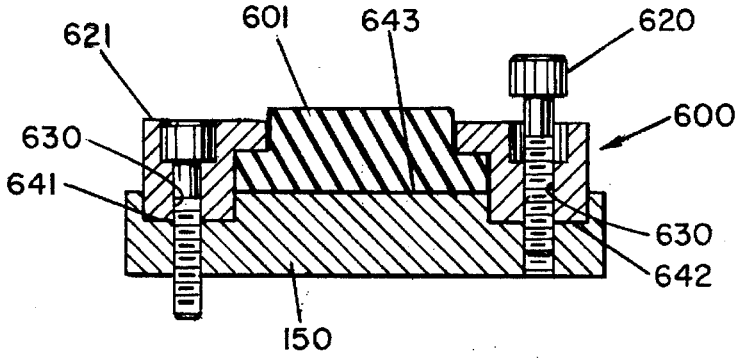
FIG. 6 is a cross-sectional view of one embodiment of the anvil attachment used with the scorer blade attachment shown in FIGS. 1 and 2.

Referring now to FIG. 6, there is shown a cross-sectional view of an anvil attachment 600 which is somewhat similar to the anvil attachment 500 shown in FIG. 5. The holder base 650 has a smooth bottom surface for mounting on the shaft, cylinder, or companion attachment apparatus. The top surface includes grooves 641 and 642 which are parallel to each other. A raised center portion 643 is formed between the grooves. The bottom surface of the anvil 601 rests on the top surface of the raised portion 643.

The holder straps 621 and 622 are inverted L-shaped members formed of the same (or similar) material as the holder base 650. The ends of the vertical arms of the straps 621 and 622 rest in the grooves 641 and 642, respectively. The horizontal arms of the straps 621 and 622 overlie the shoulders of the inverted T-shaped anvil 601. The thickness of the shoulders of anvil 601 is slightly greater than the space between the inner surface of the horizontal arms of the straps and the upper surface of the center portion 643. Holes 630 are provided through the vertical arms of straps 621 and 622. Holes 640 are provided through holder base 650. The holes 640 are located in grooves 641 and 642 and are aligned with holes 630. Thus, bolts 620 are passed through holes 630 and 640 and are threadedly engaged with the underlying cylinder or shaft (not shown). When the bolts 620 (for example, Allen-type bolts) are secured, the anvil attachment 600 is secured in place and the anvil 601 is securely clamped in the anvil attachment 600.

The embodiment of anvil attachment 600 is similar to the anvil attachment 500 shown in FIG. 5. However, slight variations in the sizes of the several components are suggested. These size adjustments or modifications are, primarily, design choice and fall within the purview of the invention described herein.

In this arrangement, the bolts 620 are removed in order to remove the support structure 600, per se from the underlying support mechanism. This also permits straps 621 and 622 to be separated from the support base 650. When the straps are separated from the base, the anvil 601 is readily removed or inserted, as appropriate. Moreover, by tightening the bolts 620, the straps 621 and 622 clamp the anvil 601 to the support base 620 and prevent slippage thereof. Thus, easier maintenance procedures are permitted while enhanced operation of the system is established.

As described supra, scorer blade 101 on one cylinder interacts with the counterpart anvil 601 on the adjacent cylinder to produce a scored line in the lengthwise direction of the web. By proper arrangement of the blades and anvils either a skip-scoring or a continuous scoring operation can be achieved. The anvil holder 600 is affixed to the conventional cylinder in any suitable fashion.

Figure 7:
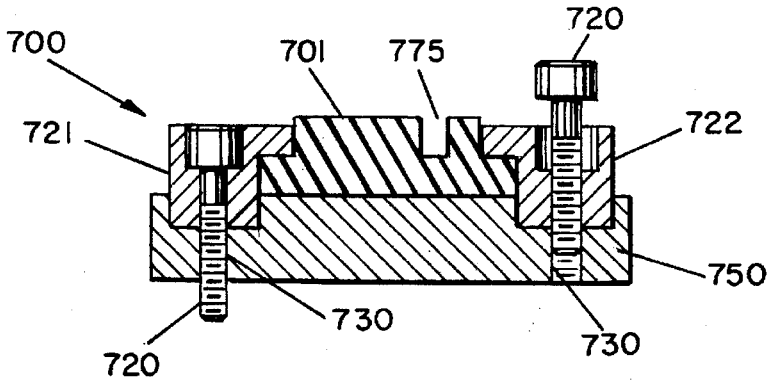
FIG. 7 is a cross-sectional view of one embodiment of the anvil attachment used with the perforator blade attachment shown in FIGS. 3 and 4.

Referring now to FIG. 7, there is shown a cross-sectional view of another embodiment of the anvil attachment in accordance with the instant invention. The anvil attachment 700 is similar to the anvil attachment shown in FIG. 6. The anvil attachment 700 shown in FIG. 7 includes a perforator anvil 701 with a groove 775 in the upper surface thereof. (Of course, in some applications, a perforator blade may merely engage and cooperate with a flat anvil such as the anvil 601 in some embodiments.)

The anvil 701 is shown mounted on the holder base 720 which includes the apertures 730 therethrough. The support strips 721 and 722 are disposed above the base support 720. Appropriate bolts 720 are passed through the holes in both of the upper straps 721 and 722, as well as the anvil base support 720. The bolts 720 engage the threaded holes in the support section (not shown). In all other respects, the perforator anvil attachment 700 is, typically, similar to the anvil attachment 600.

Figure 8:
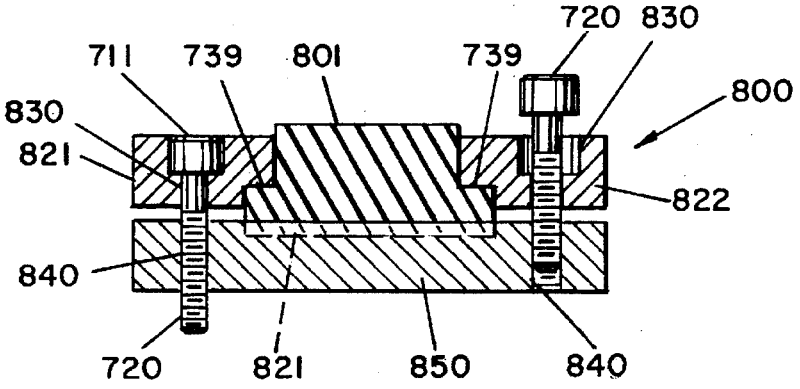
FIGS. 8 and 9 are cross-sectional views of alternate embodiments of the anvil attachment of the instant invention.

Referring now to FIG. 8, there is shown a cross-sectional view of anvil attachment 800 which is another embodiment of an anvil attachment similar to the anvil attachment 500 shown in FIG. 5. In this embodiment, the holder base 850 has a smooth bottom surface for mounting on the shaft or cylinder. The top surface is also relatively smooth but could include a central groove therein as suggested by dashed line 821. The bottom surface of the anvil 801 rests on the top surface of the holder base 850 (or in the groove 821).

The holder straps 821 and 822 are inverted L-shaped members formed of the same material as the holder base 850. The ends of the vertical arms of the straps 821 and 822 rest on the surface of holder base 850. The horizontal arms of the straps 821 and 822 overlie the shoulders of the inverted T-shaped anvil 801. In this embodiment, the horizontal arms 821 and 822 are, typically, somewhat thicker than the arms 621 and 622 of the embodiment shown in FIG. 6. The thickness of the shoulders of anvil 801 is slightly greater than the space between the inner surface of the horizontal arms of the straps and the upper surface of the holder base 850. Holes 830 are provided through the vertical arms of straps 821 and 822. Holes 840 are provided through holder base 850. The holes 840 are aligned with holes 830. Thus, bolts 820 are passed through holes 830 and 840 and are threadedly engaged with the underlying cylinder or shaft (not shown). When the bolts 820 are secured, the anvil attachment 800 is secured in place and the anvil 801 is securely clamped thereto.

When the straps are separated from the base, the anvil 801 is readily removed or inserted as appropriate. Moreover, by tightening the bolts 820, the straps 821 and 822 clamp the anvil 801 to the support base 850 and prevent slippage thereof as discussed supra.

The embodiment of anvil attachment 800 is similar to the anvil attachment 500 shown in FIG. 5. However, slight variations in the sizes and shapes of the several components are suggested. These size and shape modifications are, primarily, design choice and fall within the purview of the invention described herein.

Figure 9:
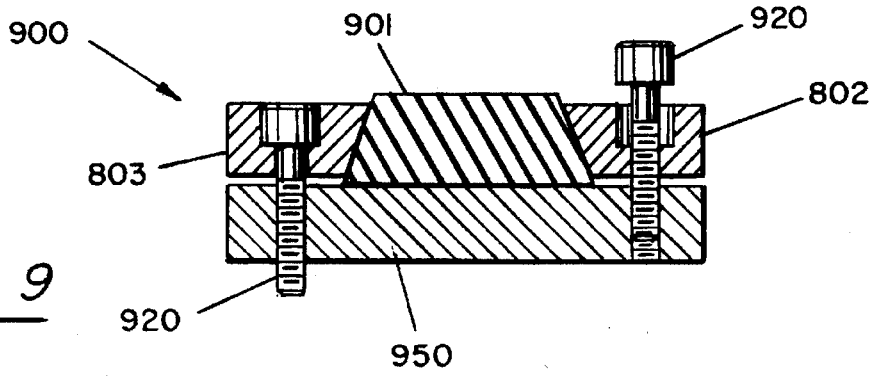

Referring now to FIG. 9, there is shown an alternative arrangement for mounting the anvil to the support. In this instance, the anvil 901 is in the shape of a trapezoid. Likewise, the support straps 921 and 922 are beveled on the opposing, inside surfaces thereof to produce a trapezoidal slot therebetween. The bolts 920 interact with the straps 921 and 922 as well as with the base support 950 as described supra. This arrangement permits easy removal and replacement of the anvil. Moreover, this arrangement may reduce wear on the shoulders of the anvil.

Thus, there is shown and described an improved attachment mounting scorer blades, perforator blades and/or anvils for use with certain printing press devices. In this instance, the attachments are mounted to cylinders in the existing equipment. However, the attachments are modified to more easily receive blades and/or anvils therein.

The particular configuration shown and described herein relates to a printing press accessory apparatus for enchancing scoring, perforating, skip scoring and/or skip perforating capabilities. While this description is directed to a particular embodiment, it is understood that those skilled in the art may conceive modifications and/or variations to the specific embodiments shown and described herein. Any such modifications or variations which fall within the purview of this description are intended to be included therein as well. It is understood that the description herein is intended to be illustrative only and is not intended to be limitative. Rather, the scope of the invention described herein is limited only by the claims appended hereto.

I claim:

1. A scorer/perforator apparatus for use with printing press equipment including support members therein, first and second arcuate support means adapted to be mounted to the support members, first bolt means for securing said first and second arcuate support means bolted to said support members by passing axially through each of said first and second support means to engage said support members, arcuate blade means, said first arcuate support means adapted to secure and support said arcuate blade means, second bolt means for securing said arcuate blade to said first arcuate means by passing through said arcuate blade means and threadedly engaging said first arcuate support means, anvil means, said second arcuate support means including a plurality of separable components adapted to secure and support said anvil means independently of said blade means, said second arcuate support means includes a base support means and at least one holder strip selectively mounted to said base support means to secure said anvil means to said second arcuate support means by said first bolt means, said first and second arcuate support means defining an arc of less than 360°.

2. The apparatus recited in claim 1 wherein, said arcuate blade means has a relatively thin, smooth edge.

3. The apparatus recited in claim 1 wherein, said arcuate blade means has a relatively thin, toothed edge.

4. The apparatus recited in claim 1 wherein, said anvil means comprises a resilient member which interacts with said blade means.

5. The apparatus recited in claim 1 wherein, said anvil means is clamped to said second arcuate support means by said holder strip.

6. The apparatus recited in claim 1 wherein, said second arcuate support means includes a groove in a surface thereof, and said anvil means includes a portion thereof which engages said groove.

7. A scorer/perforator apparatus for use with printing press equipment including at least one cylindrical support member therein for supporting a blade means and an anvil means, arcuate support means adapted to be mounted to a cylindrical support member, said arcuate support means is bolted to said cylindrical support member by bolts passing axially through said arcuate support means, anvil means, said anvil means comprises a resilient member which interacts with said blade means, said arcuate support means including a plurality of separable components adapted to secure and support said anvil means, said arcuate support means includes a base support means and at least a plurality of holder strips selectively mounted to said base support means by bolts which pass through the holder strips and the base support means thereby to secure said anvil means to said arcuate support means.

8. The apparatus recited in claim 7 wherein, said anvil means is clamped to said arcuate support means by said plurality of holder strips.

9. The apparatus recited in claim 7 wherein, said arcuate support means includes a groove in a surface thereof, and said anvil means includes a portion thereof which engages said groove.

10. The apparatus recited in claim 7 including, arcuate blade means having a relatively thin, smooth edge.

11. The apparatus recited in claim 7 including, arcuate blade means having a relatively thin, toothed edge.

12. The apparatus recited in claim 10 including, bolt means which pass through said arcuate blade means and threadedly engage said arcuate support member.

13. The apparatus recited in claim 7 wherein, said holder strips are inverted L-shaped.

14. The apparatus recited in claim 13 wherein, said anvil means includes shoulders at the edges thereof to engage said inverted L-shaped holder strips.

15. The apparatus recited in claim 9 wherein, said holder strips retain said anvil means within said groove.

16. The apparatus recited in claim 7 wherein, said anvil means includes a groove in the outer surface thereof to selectively engage said blade means.

17. The apparatus recited in claim 7 wherein, said anvil means is an inverted T-shape.

18. The apparatus recited in claim 17 wherein, the end of the vertical portion of the T-shaped anvil means extends beyond said holder strips.

19. The apparatus recited in claim 7 wherein, said holder strips and said anvil means have complementary sloped sides which engage each other.

20. The apparatus recited in claim 7 wherein, said base support means includes channel means formed in the surface thereof to receive said holder strips.

* * * * *